US006519880B2

(12) United States Patent
Robitaille

(10) Patent No.: US 6,519,880 B2
(45) Date of Patent: Feb. 18, 2003

(54) VEHICLE IMPLEMENT ADAPTER

(76) Inventor: Adrien Robitaille, 1573 Aladin, Val Bélair, Quebec (CA), G3K 1G4

( * ) Notice: Subject to any disclaimer, the term of this patent is extended or adjusted under 35 U.S.C. 154(b) by 0 days.

(21) Appl. No.: 09/911,701

(22) Filed: Jul. 25, 2001

(65) Prior Publication Data

US 2002/0014027 A1 Feb. 7, 2002

(30) Foreign Application Priority Data

Jul. 25, 2000 (GB) ..... 0018076

(51) Int. Cl.[7] ..... E01H 5/04
(52) U.S. Cl. ..... 37/231; 37/407; 414/686
(58) Field of Search ..... 172/2, 3, 4, 4.5; 37/403, 407, 348, 231; 414/686, DIG. 920

(56) References Cited

U.S. PATENT DOCUMENTS 2,909,290 A * 10/1959 Nichols ..... 172/817
2,972,424 A * 2/1961 Cadwell ..... 172/272
4,470,211 A * 9/1984 Rossmann ..... 280/511
4,554,978 A * 11/1985 Schneider ..... 172/247
4,825,570 A * 5/1989 Schmid et al. ..... 172/817
4,991,323 A * 2/1991 Benkler ..... 172/816
5,123,805 A * 6/1992 Ishimori et al. ..... 180/908
5,125,174 A * 6/1992 Watson et al. ..... 37/231
5,408,765 A * 4/1995 Lozensky ..... 172/240
5,435,082 A * 7/1995 Frenette et al. ..... 172/668
5,615,745 A * 4/1997 Cross ..... 172/776
6,116,846 A * 9/2000 Bulkley ..... 414/686
6,178,668 B1 * 1/2001 Gustafson et al. ..... 37/231

* cited by examiner

*Primary Examiner*—Robert E. Pezzuto
*Assistant Examiner*—Kristine Markovich

(57) ABSTRACT

A vehicle implement adapter for attachment to conventional vehicles and for allowing the attachment to the vehicle of various implement such as shovels, jaws or the like. The vehicle implement adapter includes a frame configured so as to be attachable to the vehicle. A main arm is pivotally attached to the frame. An implement such as a shovel, a pivotal jaw or the like is pivotally mounted at the distal end of the main arm. A cable is attached to the implement. The cable is re-directed by a set of pulleys and mechanically coupled to a winch-type mechanism mounted on the frame. A releasable locking mechanism is attached to the main arm. By selectively allowing and preventing pivotal movement of the main arm through the use of the arm locking mechanism, the cable can be used to lift and/or tilt the implement.

20 Claims, 11 Drawing Sheets

VEHICLE IMPLEMENT ADAPTER

FIELD OF THE INVENTION

The present invention relates to the general field of vehicle accessories and is particularly concerned with a vehicle implement adapter that can be easily attached to conventional vehicles such as all terrain vehicles and converted into various utility components such as trowels, prehension tools or the like.

BACKGROUND OF THE INVENTION

The exists a wide variety of situations wherein it would be desirable to temporarily transform a conventional vehicle such as a conventional all terrain vehicle into a utility-type of vehicle for various operations such as shoveling, transportation of logs and other goods or the like.

The prior art is replete with various types of adapters designed to be mounted on conventional vehicles for converting the latter into utility vehicles. However, most of the prior art adapters suffer from a set of drawbacks, including overall mechanical complexity and lack of versatile. Accordingly, there exists a need for an improved vehicle implement adapter.

Advantages of the present invention include that the proposed vehicle implement adapter is specifically designed so as to be readily mountable to conventional vehicles such as conventional all terrain-type vehicles through a set of ergonomic steps without requiring special tooling or manual dexterity. Furthermore, the proposed vehicle implement adapter is designed so as to be mountable to conventional vehicles without requiring alteration to the vehicles and with reduced risks of damaging the vehicle when the adapter is mounted thereon.

Also, the proposed vehicle implement adapter presents a structure that allows for both lifting and tilting of the attached implement through the use of a single winch-type mechanism thus presenting a structure that is mechanically simple. The overall mechanical simplicity of the proposed vehicle implement adapter is associated with reduced manufacturing cost and improved reliability. One of the main advantages of the present invention resides that through the use of a single locking mechanism, ergonomically accessible by the user, the implement can be either raised and/or tilted.

Furthermore, the proposed vehicle implement adapter is particularly well suited to perform various functions such as shoveling, transportation of goods or the like. Still further, the proposed vehicle implement adapter is specifically designed so as to reduce the risks of lateral and longitudinal tilting of the vehicle to which it is attached during the transportation of particularly heavy loads.

The proposed vehicle implement adapter is also adapted to conform to conventional forms of manufacturing, to be of simple construction and easy to use so as to provide a vehicle implement adapter that will be economically feasible, long lasting and relatively trouble free in operation.

SUMMARY OF THE INVENTION

In accordance with an embodiment of the invention, there is provided a vehicle implement adapter for attachment to a conventional vehicle, the conventional vehicle defining a vehicle front end and a vehicle rear end, the conventional vehicle including a vehicle front attachment component positioned adjacent the vehicle front end and a vehicle rear attachment component positioned adjacent the vehicle rear end, the adapter comprising: a frame, the frame being configured so as to be attachable to the vehicle; a main arm having a generally elongated configuration defining a main arm first longitudinal end and an opposed main arm second longitudinal end, the main arm first longitudinal end being pivotally attached to the frame so as to be pivotable about a main arm pivotal axis between a main arm first pivotal position and a main arm second pivotal position, the main arm second pivotal position being in an overlying relationship relative to the main arm first pivotal position; an implement defining an implement proximal end and an implement distal end, the implement being pivotally attached to the main arm second longitudinal end so as to be pivotable about an implement pivotal axis between an implement first pivotal position and an implement second pivotal position, the implement second pivotal position being in an overlying relationship relative to the implement first pivotal position; a main actuating means attached to both the frame and the implement for exerting a pulling action against the gravitational force on the implement, the pulling action being oriented so as to be able both to pivot the implement about the implement pivotal axis and to pivot the main arm about the main arm pivotal axis; a main arm locking means attached to the main arm for selectively and releasably locking the main arm in a predetermined angular relationship relative to the frame; the main actuating means and the main arm locking means being configured such that when the main arm locking means locks the main arm against pivotal movement about the main arm pivotal axis the pulling action of the main actuating means pivots the implement towards the implement second pivotal position while the release of the pulling action allows the gravitational force to pivot the implement towards the implement first pivotal position and, when the main arm is free to pivot about the main arm pivotal axis, the pulling action of the main actuating means pivots both the implement towards the implement second pivotal position and the main arm towards the main arm first position while the release of the pulling action allows the gravitational force to pivot both the implement towards the implement first position and the main arm towards the main arm first position.

Preferably, the main arm locking means includes a mast extending from the frame, the mast defining a mast longitudinal axis, a mast first longitudinal end and a mast second longitudinal end, the mast being mounted on the frame about the mast first longitudinal end so as to be located intermediate the main arm first and second longitudinal ends; a main arm-to-mast connecting means slidably mounted on the mast and pivotally attached to the main arm intermediate the main arm first and second longitudinal ends for slidably and pivotally connecting the main arm to the mast; a mast connector locking means for selectively and releasably locking the relative movement between the main arm-to-mast connecting means and the mast.

Conveniently, the main arm-to-mast connecting means includes a mast sleeve slidably mounted on the mast the mast sleeve defining a sleeve peripheral wall; the mast connector locking means includes a locking pin mounted on the mast sleeve; at least one mast pin aperture formed in the mast for receiving a section of the locking pin; a sleeve pin aperture extending through a section of the sleeve peripheral wall for receiving a section of the locking pin, the sleeve pin aperture being configured, sized and positioned relative to the sleeve so as to be positionable substantially in register with the at least one mast pin aperture by sliding the mast sleeve released configuration wherein the locking pin clears the at least one mast pin aperture relative to the mast; the locking pin being mounted on the sleeve so as to be movable between a pin locked configuration wherein the locking pin extends through both the at least one mast pin aperture and the sleeve pin aperture and a pin released configuration wherein said locking pin clears said mast pin aperture; a pin actuating means for moving the locking pin between the pin locked and pin released configurations.

Preferably, the locking pin is pivotally mounted to the mast sleeve and wherein the pin actuating means includes a pin pulling arm extending at an angle from the locking pin, the pin pulling arm being mechanically coupled to a pin pulling cable for pulling the locking pin towards the pin released configuration; a pin pushing arm extending at an angle from the locking pin, the pin pushing arm being mechanically coupled to a biasing means for biasing the locking pin towards the pin locked configuration.

Conveniently, the at least one mast pin aperture extends at an angle relative to the mast longitudinal axis, the locking pin being oriented so as to slide into the at least one mast pin aperture at a corresponding pin angle.

Preferably, the vehicle implement adapter further comprises an implement pivotal range limiting means for selectively limiting the pivotal movement of the implement within a predetermined implement pivotal range.

In one embodiment of the invention, the implement pivotal range limiting means includes a guiding track mounted on the main arm, the guiding track defining a track first longitudinal end and an opposed track second longitudinal end; a guiding arm, the guiding arm defining a guiding arm first longitudinal end and an opposed guiding arm second longitudinal end, the guiding arm first longitudinal end being pivotally attached to the implement, the guiding arm second longitudinal end being slidably mounted to the guiding track for slidable movement therealong, the guiding track being provided with range limiting components selectively positionable along the guiding track for abuttingly limiting the relative movement between the guiding arm second longitudinal end and the guiding track.

In another embodiment of the invention, the implement pivotal range limiting means includes a range limiting arm, the range limiting arm defining a range limiting arm first longitudinal end and an opposed range limiting arm second longitudinal end, the range limiting arm first longitudinal end being pivotally attached to the main arm adjacent the main arm second longitudinal end, the range limiting arm second longitudinal end being provided with an abutment tip; an arm pivoting mechanism attached to the range limiting arm and extending towards the frame for pivoting the range limiting arm to a predetermined angular relationship relative to the main arm; a serrated surface formed on the implement adjacent the main arm, the serrated surface being provided with indentations configured and sized for receiving the abutment tip, the serrated surface being positioned so that the abutment tip is inserted into one of the indentations when the implement is pivoted towards the implement second pivotal position, the relative angle between the range limiting arm and the main arm determining the pivotal range of the implement.

Preferably, the main actuating means includes a main cable, the main cable defining a cable distal end and a cable proximal end; a winch mounted on the frame; the cable distal end being attached to the implement so as to allow the cable to pull the implement towards the implement second pivotal position and the cable proximal end being coupled to the winch.

Conveniently, the main actuating means includes a main cable, the main cable defining a cable distal end and a cable proximal end; a winch mounted on the frame; a main cable pulley attached to the mast adjacent the mast second longitudinal end; the cable distal end being attached to the implement so as to allow the cable to pull the implement towards the implement second pivotal position, the cable proximal end being coupled to the winch, the cable being at least partially winded about the main cable pulley intermediate the cable first and second longitudinal ends.

Preferably, the frame defines a frame first longitudinal end and an opposed frame second longitudinal end, the frame including a frame attachment section for attachment to the conventional vehicle; a frame supporting section for supporting at least a portion of the weight of the main arm and of the implement, the frame supporting section being pivotally mounted to the frame attachment section, adjacent the frame attachment section, the frame supporting section including a supporting wheel for rollably supporting the frame supporting section.

Conveniently the vehicle implement adapter further includes a suspension means attached between the frame attachment section and the frame supporting section for resiliently biasing the frame attachment section and the frame supporting towards a predetermined angular relationship relative to each other.

Preferably, the frame attachment section includes a generally elongated attachment rod, the attachment rod including a first rod attachment means for attaching the attachment rod to the vehicle rear attachment component and a second rod attachment means for attaching the attachment rod to the vehicle front attachment component, the second rod attachment means including a pivotal link between the vehicle front attachment component and the attachment rod.

Conveniently, the frame defines a frame first longitudinal end and an opposed frame second longitudinal end, the frame including a frame attachment section for attachment to the conventional vehicle; a frame supporting section for supporting at least a portion of the weight of the main arm and of the implement, the frame supporting section being pivotally mounted to the frame attachment section, adjacent the frame attachment section, the frame supporting section including a supporting wheel for rollably supporting the frame supporting section; the frame further including a suspension means attached between the frame attachment section and the frame supporting section for resiliently biasing the frame attachment section and the frame supporting towards a predetermined angular relationship relative to each other; the frame attachment section including a generally elongated attachment rod, the attachment rod including a first rod attachment means for attaching the attachment rod to the vehicle rear attachment component and a second rod attachment means for attaching the attachment rod to the vehicle front attachment component, the second rod attachment means including a pivotal link between the vehicle front attachment component and the attachment rod, the mast extending from the frame supporting section and the main arm being pivotally attached to the frame attachment section.

In one embodiment, the implement includes a shovel defining a shovel scooping wall and a shovel abutment wall. Conveniently, the vehicle implement further comprises a means for locking the shovel in a predetermined angular relationship relative to the main arm.

In another embodiment, the vehicle implement adapter further comprises a generally "L"-shaped implement bracket rigidly attached to the main arm second longitudinal end and wherein the implement includes a jaw component pivotally mounted on the implement bracket for pivotal movement between the implement first position wherein the jaw member is in a closed configuration relative to the implement bracket and the implement second position wherein the jaw member is in an open configuration relative to the implement bracket.

BRIEF DESCRIPTION OF THE DRAWINGS

An embodiment of the present invention will now be disclosed, by way of example, in reference to the following drawing, in which:

FIG. 9: in a side elevational view with sections taken out, illustrates some of the components of the vehicle implement adapter in accordance with the second embodiment of the invention, the vehicle implement adapter being shown with its implement pivoted between first and second pivotal positions.

DETAILED DESCRIPTION

Figure 1:
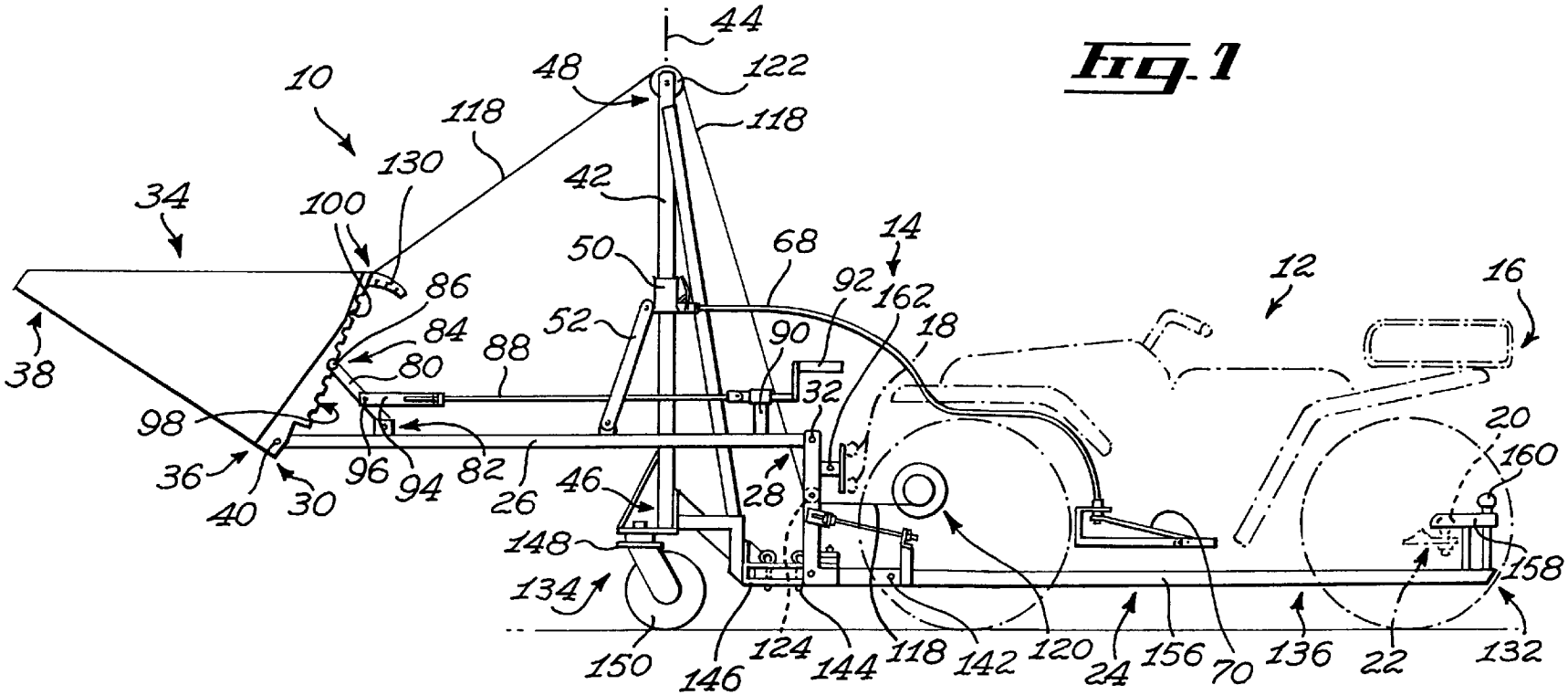
FIG. 1: in a side elevational view, illustrates a vehicle implement adapter in accordance with the first embodiment of the invention mounted to a conventional vehicle, the conventional vehicle being shown in phantom lines.

Referring to FIG. 1, there is shown a vehicle implement adapter (10) in accordance with an embodiment of the present invention. The vehicle implement adapter (10) is shown attached to a conventional vehicle (12), illustrated schematically in phantom lines. Although the vehicle illustrated is of the conventional "all terrain vehicle" type, it should be understood that the vehicle implement adapter (10) in accordance with the present invention could be used with other types of vehicles without departing from the scope of the present invention.

The conventional vehicle illustrated schematically and referred to by reference numeral (12) defines a vehicle front end (14) and an opposed vehicle rear end (16). The conventional vehicle (12) includes a vehicle front attachment component positioned adjacent the vehicle front end (14). Typically, the vehicle front attachment component may include a section of the bumper (18) of the vehicle (12). Also, the conventional vehicle (12) includes a vehicle rear attachment component positioned adjacent the vehicle rear end (16). The vehicle rear attachment component typically includes a conventional vehicle hitch ball (20) mounted to the vehicle (12) by a conventional hitch ball mounting structure (22).

Figure 2:
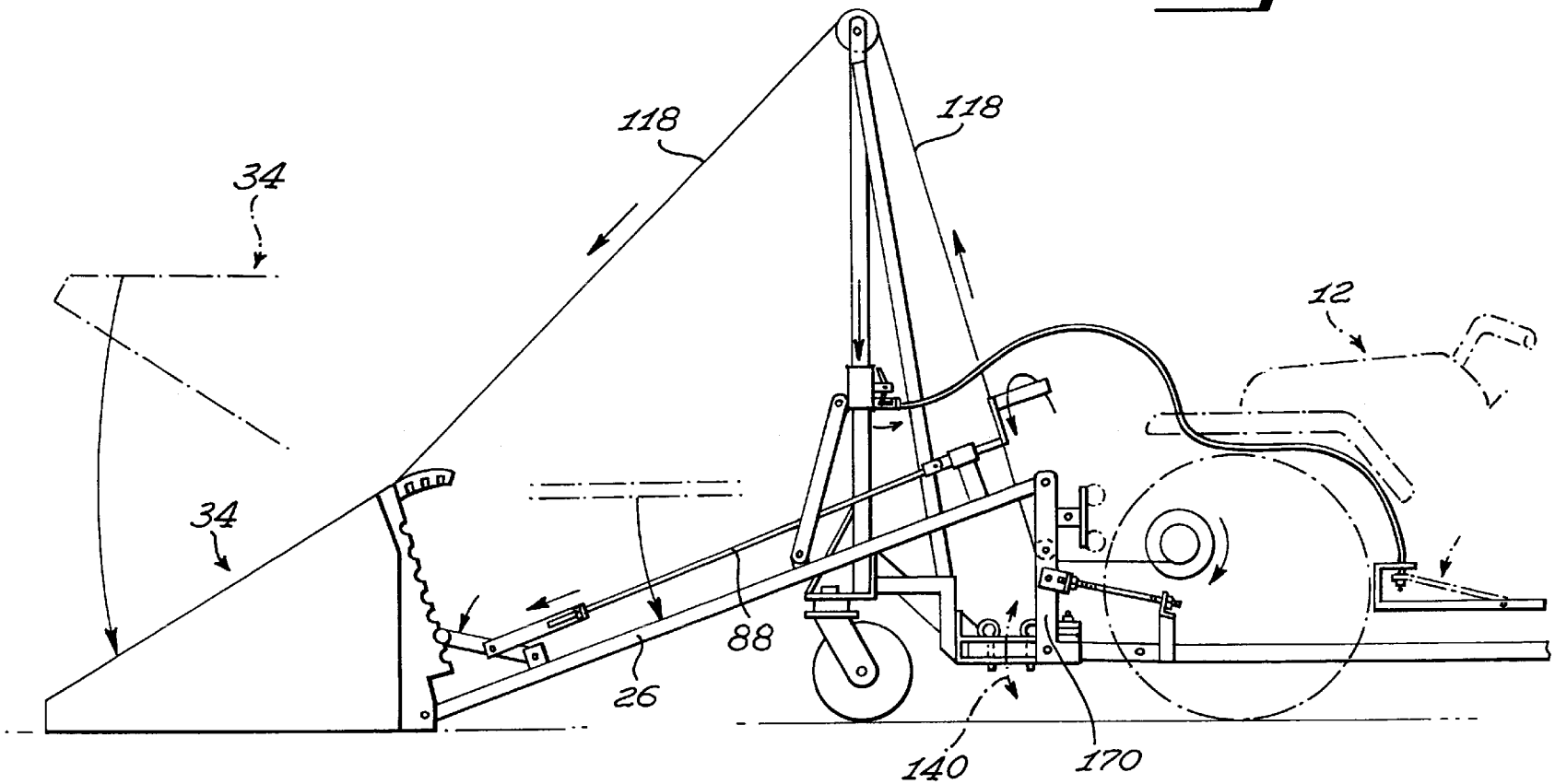
FIG. 2: in a side elevational view with sections taken out, illustrates the vehicle implement adapter shown in FIG. 1 with its implement being moved between first and second implement pivotal positions. One of the pivotal positions being shown in phantom lines.
Figure 3:
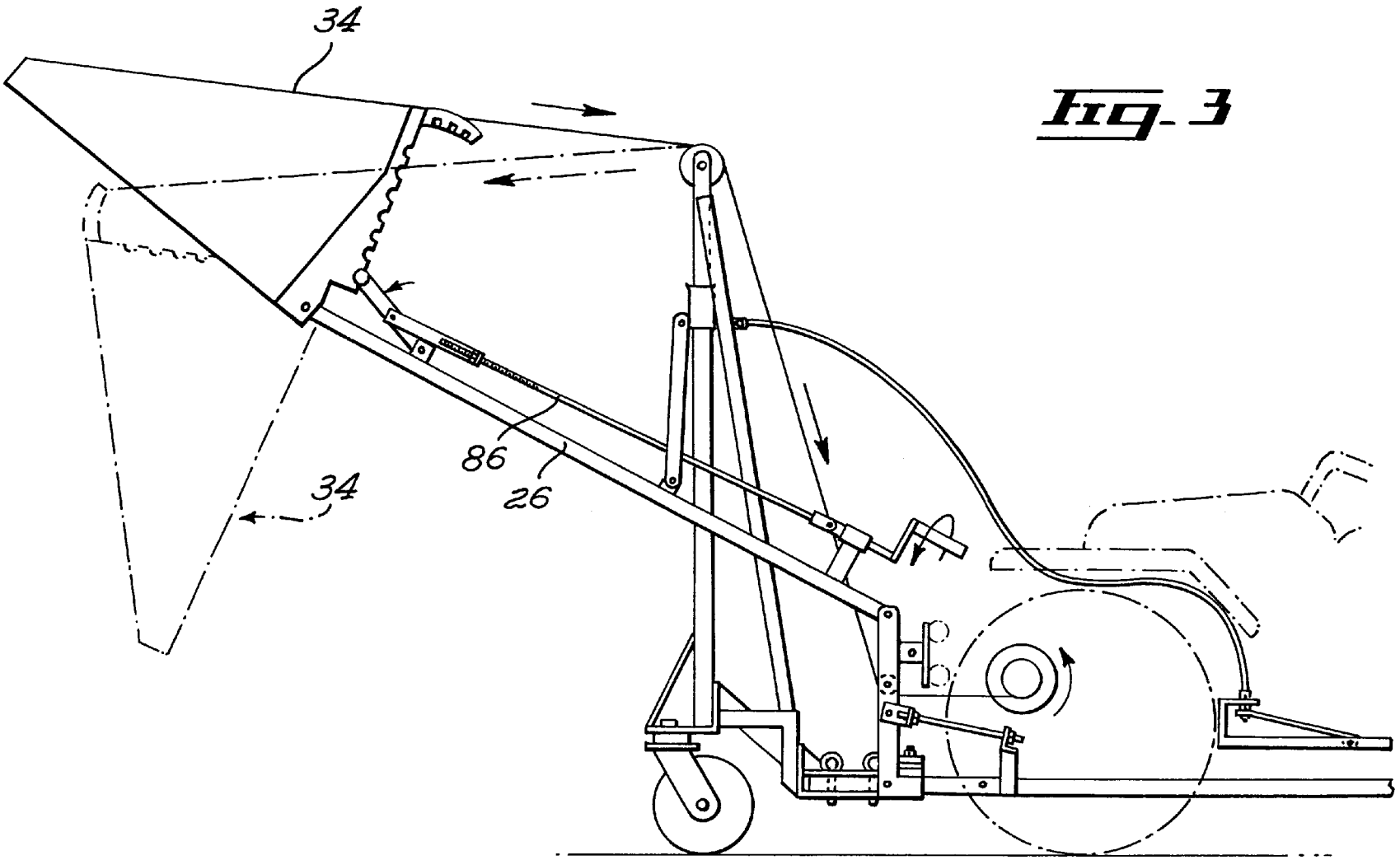
FIG. 3: in a side elevational view with sections taken out, illustrates the vehicle implement adapter shown in FIGS. 1 and 2 with its main arms in a raised configuration and with its implement being moved between first and second implement pivotal positions.
Figure 8:
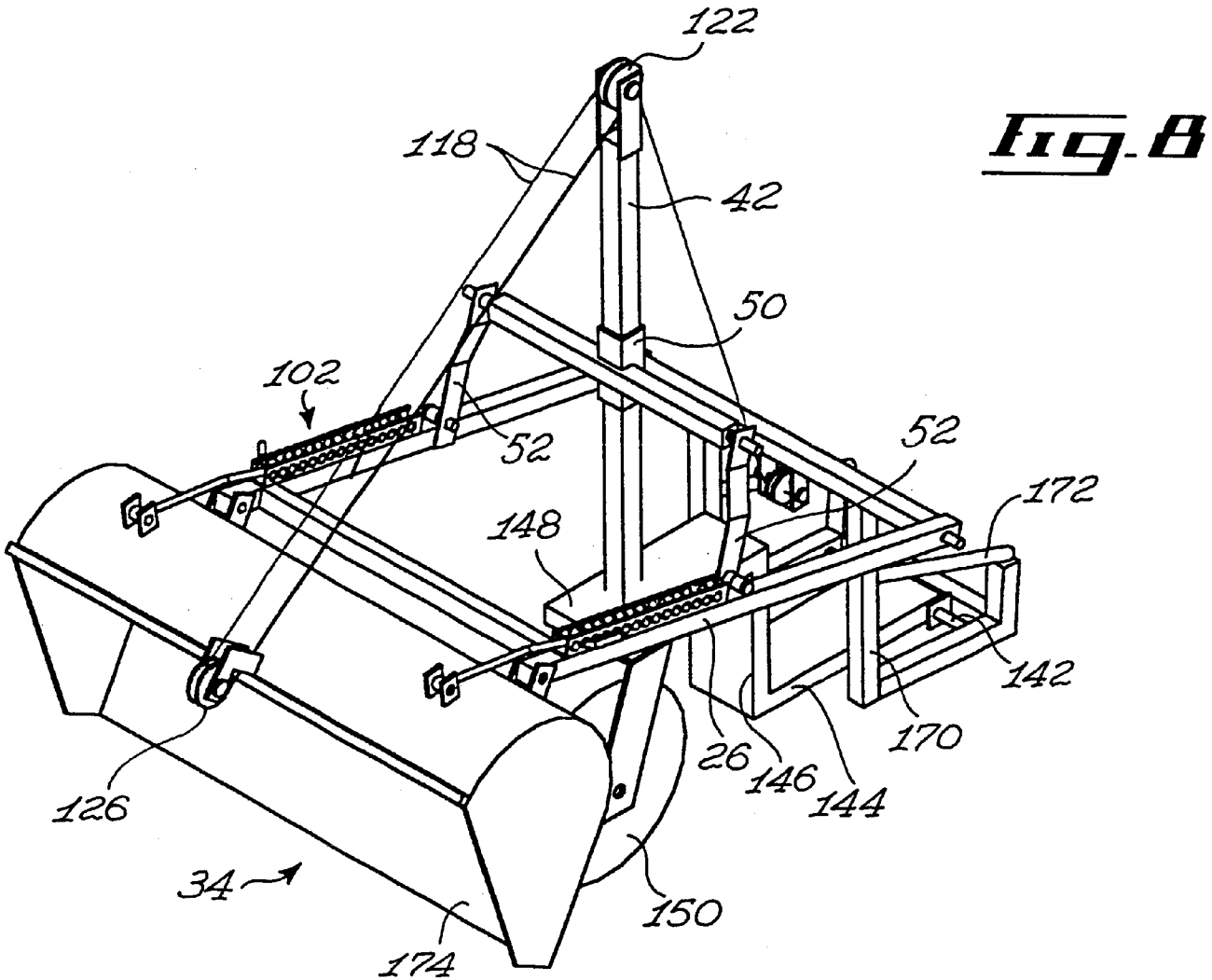
FIG. 8: in a perspective view, illustrates some of the components of the vehicle implement adapter in accordance with the second embodiment of the invention.
Figure 6:
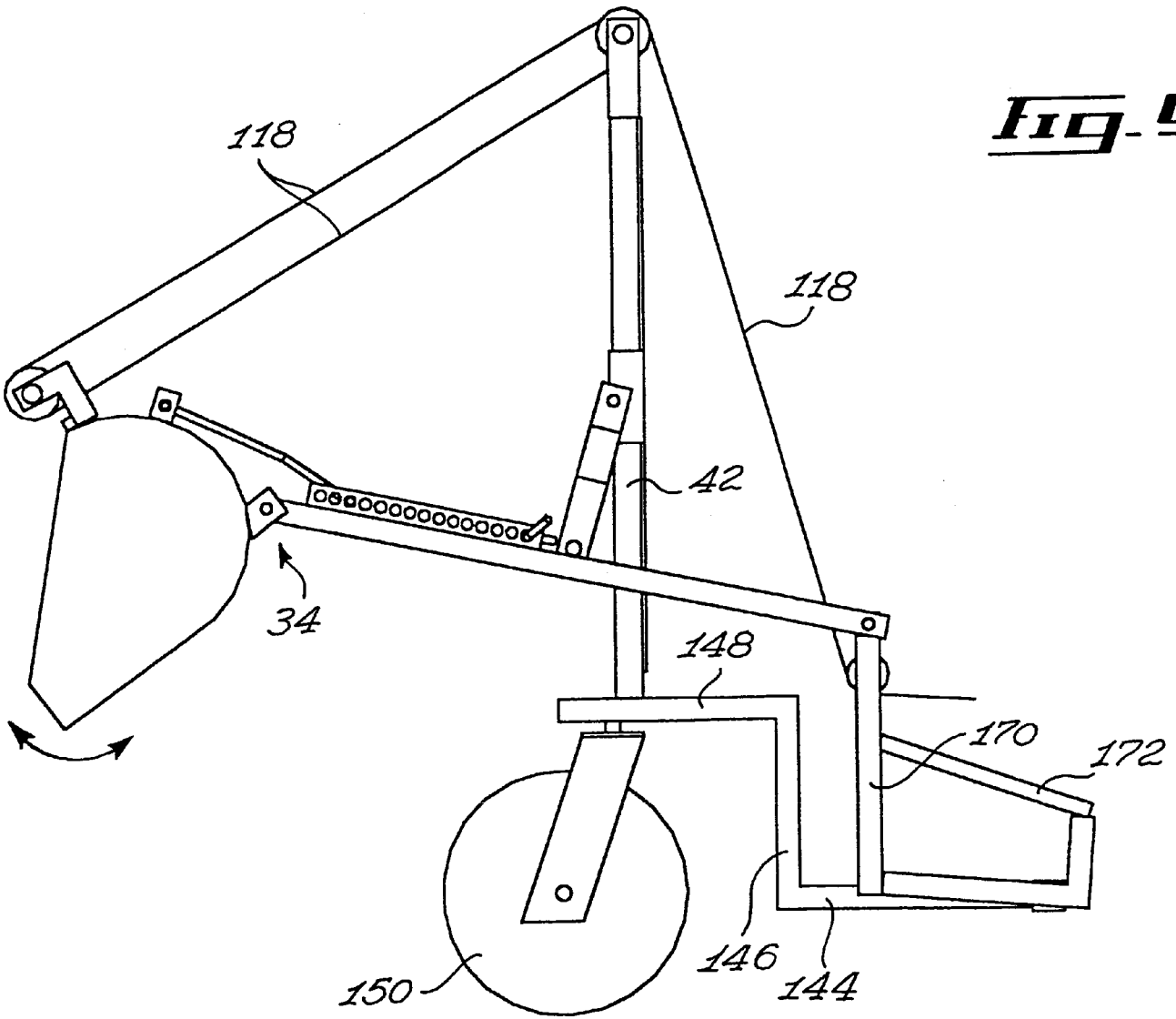
Figure 10:
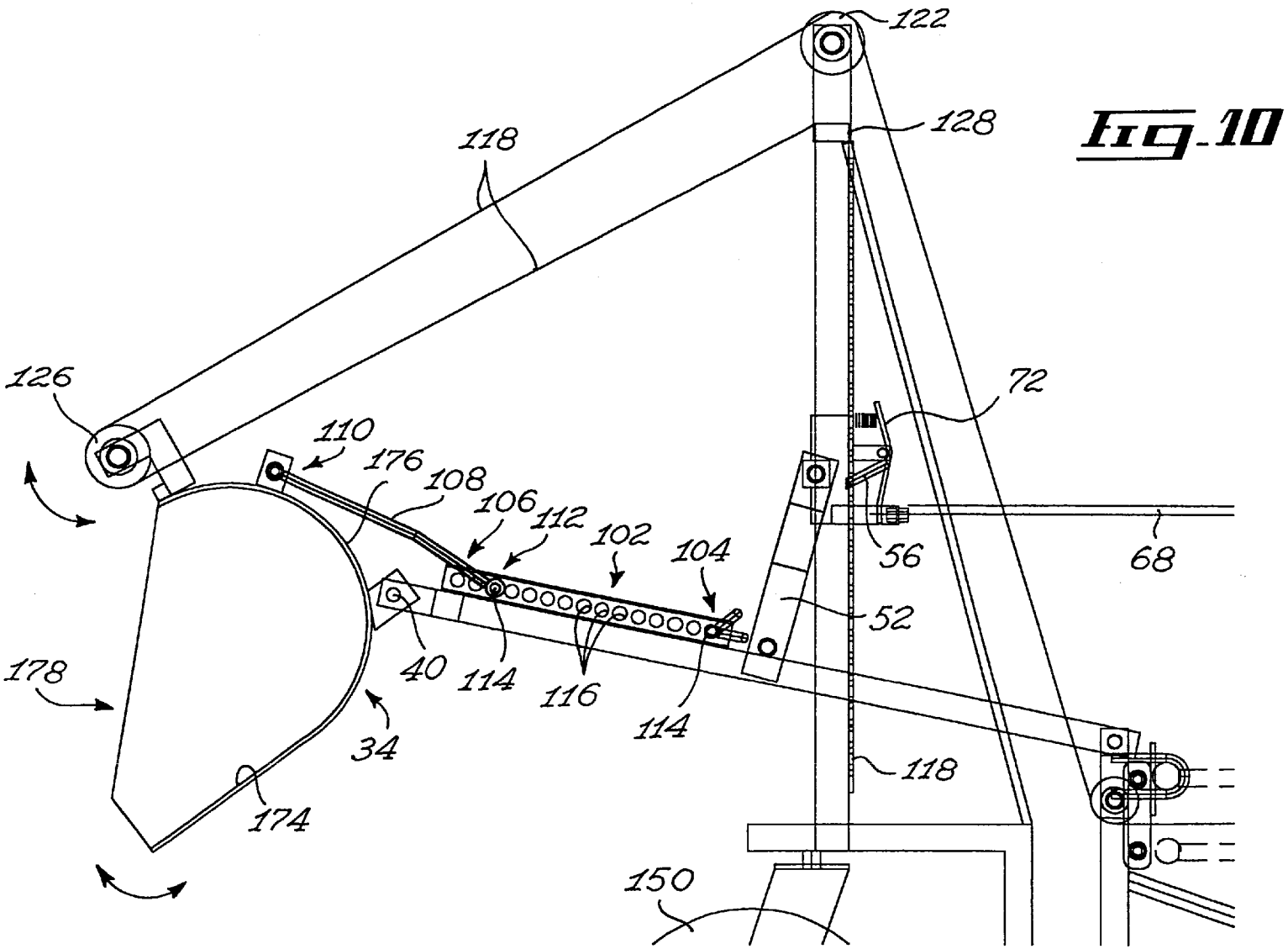
FIG. 10: in a partial side elevational view with sections taken out, illustrates some of the components of the vehicle implement adapter in accordance with the second embodiment of the invention.
Figure 11:
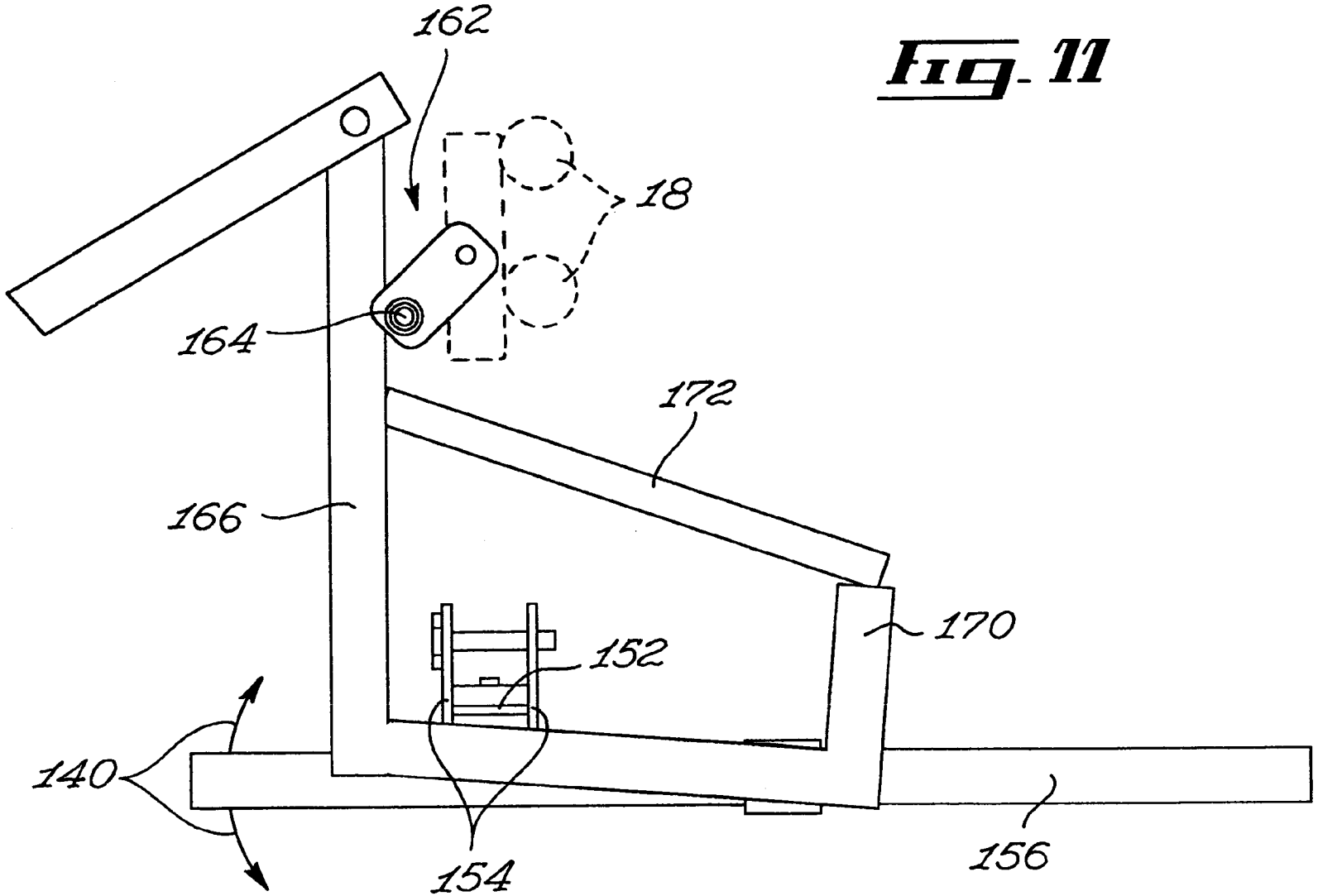
FIG. 11: in a side elevational view with sections taken out, illustrates part of the link between the frame attachment section and the frame supporting section, both part of the vehicle implement adapter in accordance with the present invention.
Figure 12:
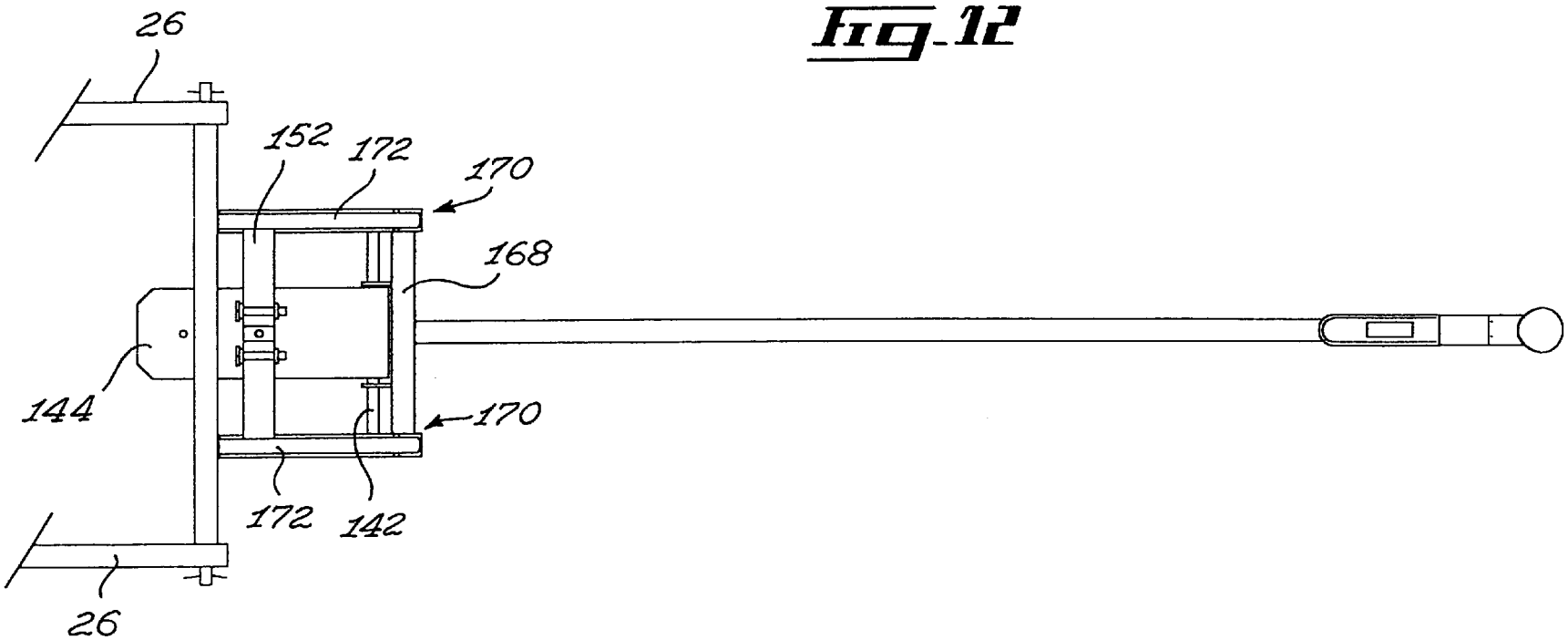
FIG. 12: in a top view, illustrates some of the components of the frame associated with the vehicle implement adapter in accordance with the present invention.

The vehicle implement adapter (10) includes a frame (24) that is configured and sized so as to be attachable to the vehicle (12). The vehicle implement adapter (10) also includes a main arm (26) having a generally elongated configuration. The main arm (26) defines a main arm first longitudinal end (28) and an opposed main arm second longitudinal end (30). The main arm first longitudinal end (28) is pivotally attached preferably to a front section of the frame (24) so as to be pivotable about a main arm pivotal axis (32) between a main arm first pivotal position, illustrated in full lines in FIG. 2 and a main arm second pivotal position, illustrated in full lines in FIG. 3. Although FIGS. 2 and 3 illustrate typical examples of main arm first and second pivotal positions, it should be understood that other main arm first and second pivotal positions could be defined without departing from the scope of the present invention as long as the main arm second pivotal position is in an overlying relationship relative to the main arm first pivotal position. Preferably, the vehicle implement adapter includes not only one main arm but a pair of main arms (26), both pivotally attached to the frame (24) for pivotal movement between the main arm first and second pivotal positions, as shown more specifically in FIG. 8.

The vehicle implement adapter (10) also includes an implement (34), defining an implement proximal end (36) and an opposed implement distal end (38). The implement (34) is pivotally attached to the main arm second longitudinal end (30) so as to be pivotable about an implement pivotal axis (40) between an implement first pivotal position, illustrated in phantom lines in FIG. 3 and an implement second pivotal position, illustrated in full lines in FIG. 3. Again, it should be understood that the implement first and second pivotal positions, shown in FIG. 3, are only illustrated by way of example and that other implement first and second pivotal positions could be defined without departing from the scope of the present of the present invention as long as the implement second pivotal position is in overlying relationship relative to the implement first pivotal position.

The vehicle implement adapter (10) further includes a main actuating means attached to both the frame (24) and the implement (34) for exerting a pulling action against the gravitational force on the implement (34). The pulling action exerted by the main actuating means being oriented so as to be able to both pivot the implement (34) about the implement pivotal axis (40) and to pivot the main arm (26) about the main arm pivotal axis (32).

The vehicle implement adapter (10) still further includes a main arm locking means attached to the main arm (26) for selectively and releasably locking the main arm (26) in a predetermined angular relationship relative to the frame (24). The main actuating means and the main arm locking means are configured such that when the main arm locking means locks the main arm (26) against pivotal movement about the main arm pivotal axis (32), the pulling action of the main actuating means pivots the implement (34) towards the implement second pivotal position while the release of the pulling action allows the gravitational force to pivot the implement (34) towards the implement first pivotal position. The main actuating means and the main arm locking means are also configured so such that when the main arm (26) is free to pivot about the main arm pivotal axis (32), the pulling action of the main actuating means pivots both the implement (34) and the main arm (26) respectively towards the implement second pivotal position and the main arm second pivotal position while the release of the pulling action allows the gravitational force to pivot both the implement (34) towards the implement first pivotal position and the main arm (26) towards the main arm first pivotal position.

Preferably, the locking means includes a mast (42) extending from the frame (24). The mast (42) defines a mast longitudinal axis (44), a mast first longitudinal end (46) and a mast second longitudinal end (48). The mast (42) is mounted on the frame (24) about the mast first longitudinal end (46) so as to be located substantially intermediate the main arm first and second longitudinal ends (30), (32).

The main arm locking means also includes a main arm-to-mast connecting means, slidably mounted on the mast (42) and pivotally attached to the main arm (26), intermediate the main arm first and second longitudinal ends (28), (30) for slidably and pivotally connecting the main arm (26) to the mast (42). The main arm locking means still further includes a mast connector locking means for selectively and releasably blocking the relative movement between the main arm-to-mast connecting means and the mast (42).

The main arm-to-mast connecting means typically includes a mast sleeve (50) slidably mounted on the mast (42). The mast sleeve (50) defines a corresponding sleeve peripheral wall (54). The main arm-to-mast connecting means preferably further includes a main arm-to-sleeve auxiliary arm (52) pivotally attached at a first longitudinal end thereof to the sleeve (50) and at the opposed longitudinal end thereof to the main arm (26) intermediate the main arm first and second longitudinal ends (28), (30).

Figure 4:
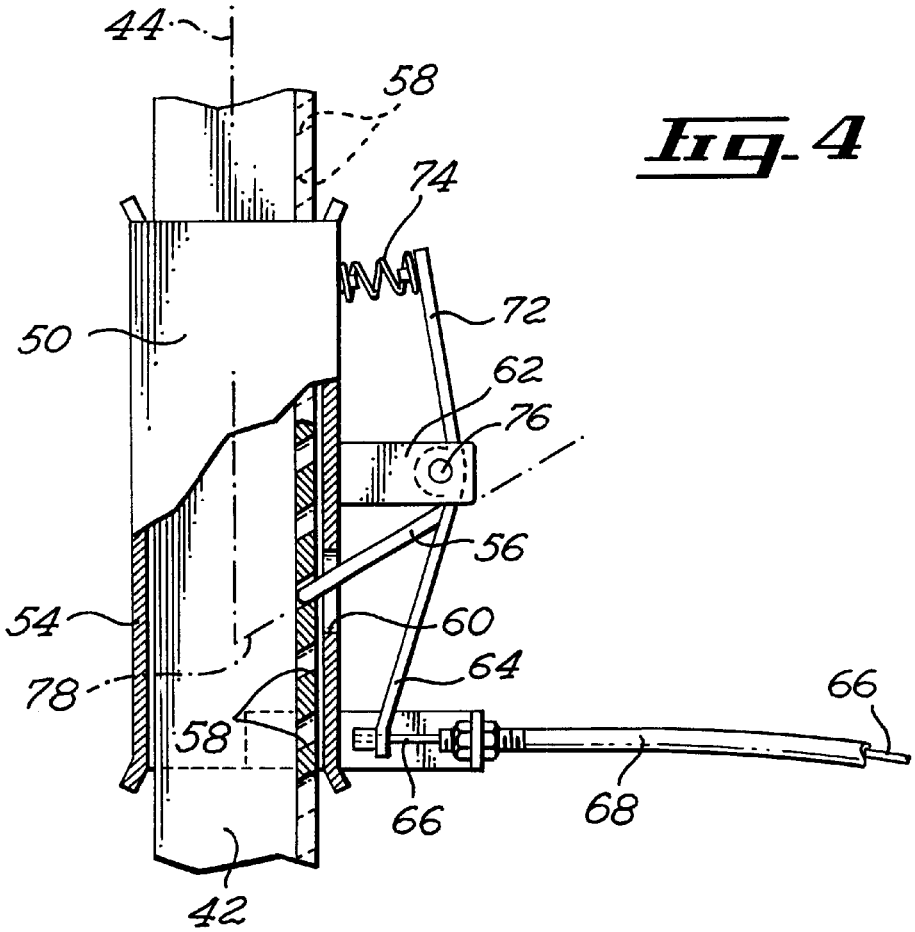
FIG. 4: in a detail view with sections taken out, illustrates par t of a mast sleeve locking mechanism, part of the vehicle implement adapter shown in FIGS. 1 through 3.
Figure 5:
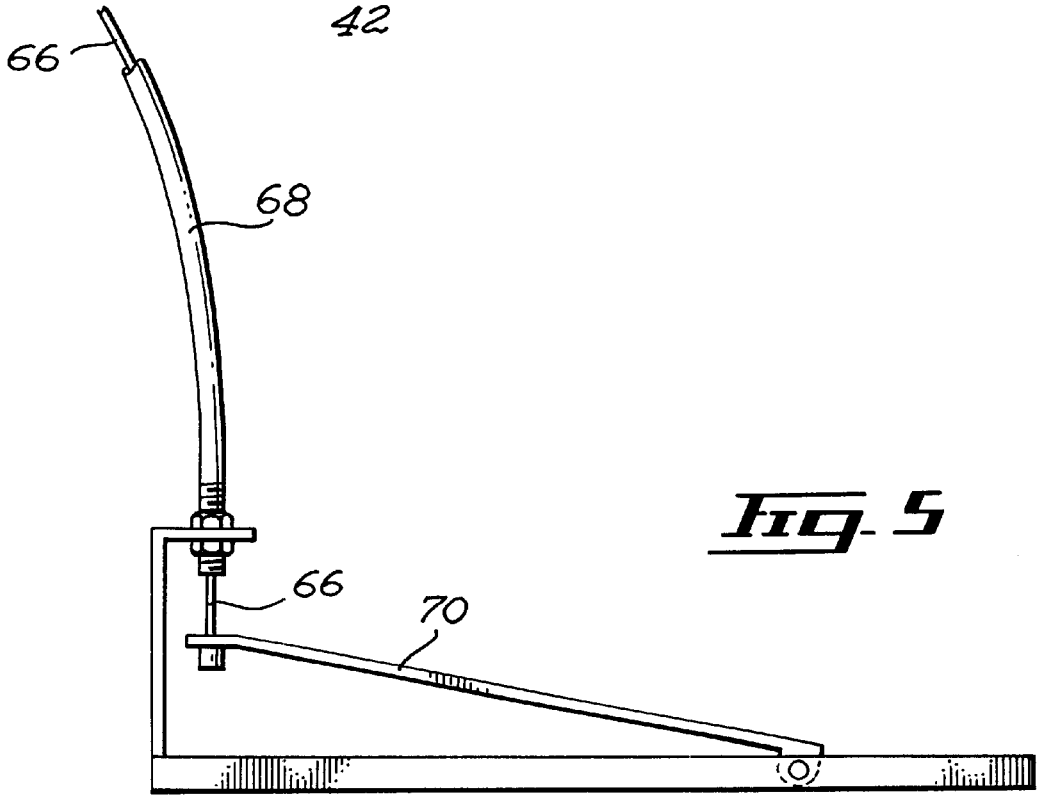
FIG. 5: in a partial side view with sections taken out, illustrates a pedal actuator, mechanically coupled to the mast sleeve locking mechanism shown in FIG. 4, also part of the vehicle implement adapter shown in FIGS. 1 through 3.
Figure 6:
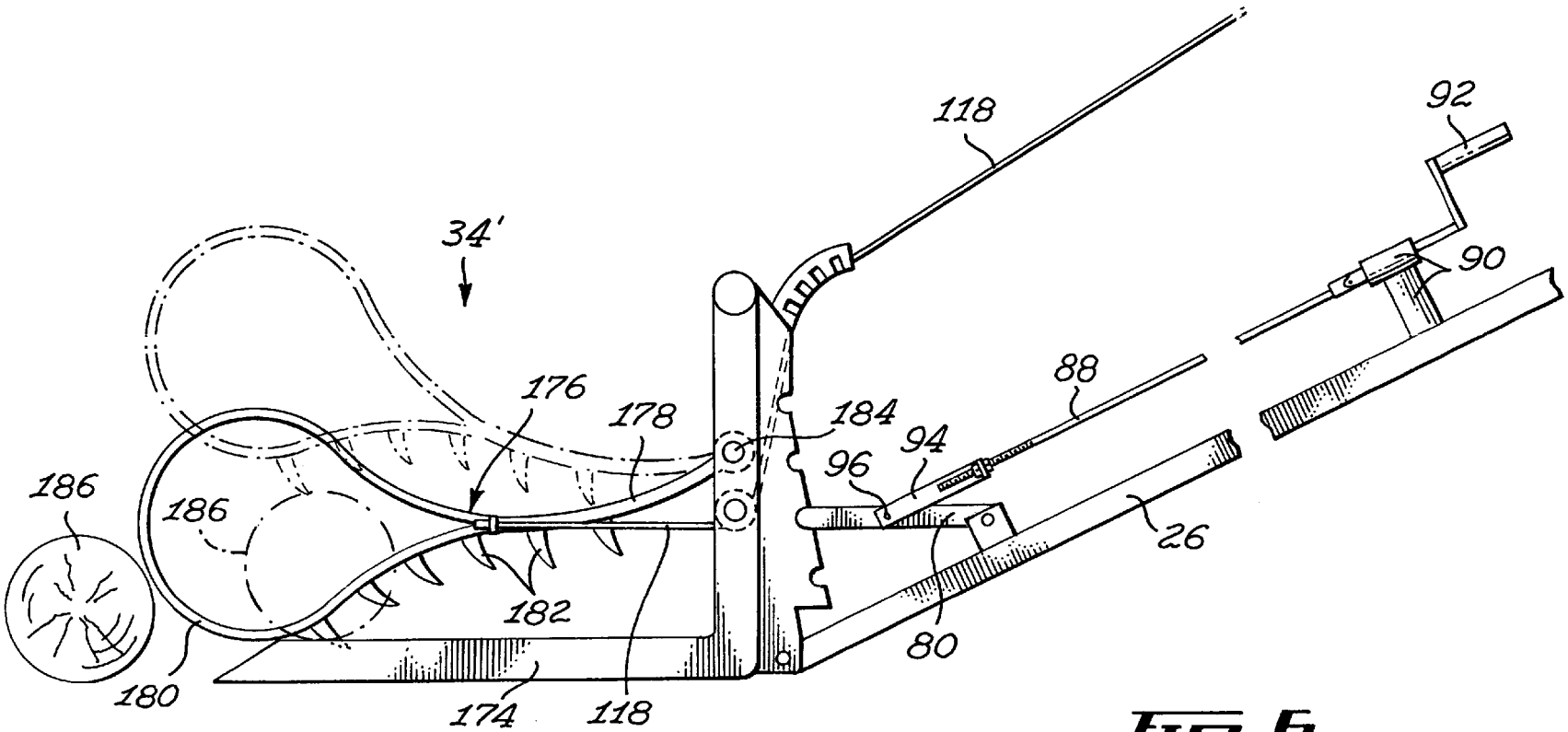
FIG. 6: in a partial side view with sections taken out, illustrates an alternative embodiment of the implement, part of the vehicle implement adapter in accordance with the present invention.
Figure 7:
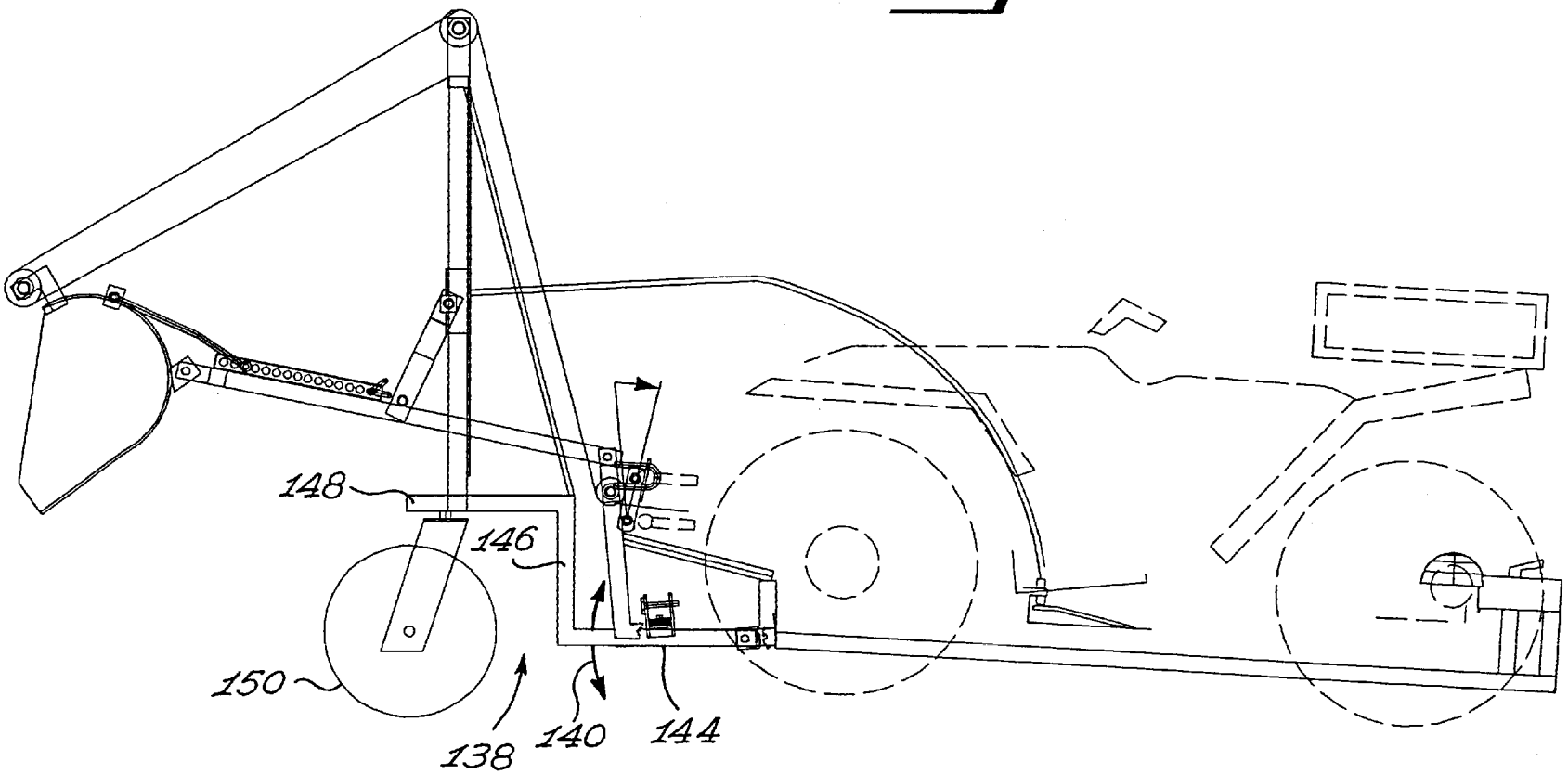
FIG. 7: in a side elevational view, illustrates a vehicle implement adapter in accordance with a second embodiment of the present invention. The vehicle implement adapter being shown attached to a conventional vehicle, the conventional vehicle being shown in phantom lines.

A preferred embodiment of mast connector locking means is illustrated in greater details in FIGS. 4 and 5. Typically, the mast connector locking means includes a locking pin (56) mounted on the mast sleeve (54). At least one and preferably a plurality of mast pin apertures (58) are formed in the mast (42) for receiving a section of the locking pin (56). Also, a sleeve pin aperture (60) extends through a section of the sleeve peripheral wall (54) for receiving a section of the locking pin (56). The sleeve pin aperture (56) is configured, sized and positioned relative to the sleeve (50) so as to be positionable substantially in register with one of the mast pin apertures (58) while sliding the mast sleeve (50) longitudinally along said mast (42).

The locking pin (56) is mounted on the sleeve (54) so as to be moveable between locked configuration shown in FIG. 4 wherein the locking pin (56) extends through both the sleeve aperture (60) and one of the mast pin apertures (58) and a pin released configuration wherein the locking pin (56) clears the mast pin apertures (58). The mast connector locking means further includes a pin actuating means for moving the locking pin (56) between the pin locked and released configurations.

Still referring to FIG. 4, there shown that the locking pin (56) is preferably pivotally mounted on the mast sleeve (50), being typically pivotally attached to a spacing member (62).

The pin actuating means, typically includes a pin pulling arm (64), extending at an angle from the locking pin (56). The pin pulling arm (64) being mechanically coupled to a pin pulling cable (66) for pulling the locking pin (56) towards the pin released configuration. The pin pulling cable (66) preferably extends within a cable protecting sleeve towards the vehicle (12). The opposed longitudinal end of the pin pulling cable (66) is preferably mechanically coupled to a cable actuating means preferably taking the form of a foot actuated pedal (70) mounted on the vehicle (12).

The pin actuating means preferably further includes a pin pushing arm (72) extending at an angle from the locking pin (56). The pin pushing arm (72) is preferably mechanically coupled to a biasing means for biasing the locking pin (56) towards the pin locked configuration. The biasing means typically takes the form of an helicoidal-type spring (74) compressively mounted between the sleeve peripheral wall (54) and the pin pushing arm (72). The locking pin (56), the pin pulling arm (64) and the pin pushing arm (72) are all adapted to pivot solidarity with one another about a locking arrangement pivotal axis (76).

Preferably, the mast pin apertures (58) extend at an angle relative to the mast longitudinal axis (44). Typically, the angle of the mast pin apertures (58) is such that the outer section of the mast pin apertures (58) is positioned at a higher lever than the inner surface of the mast pin apertures (58). The locking pin (56) is configured, sized and oriented so as to slide into the mast pin apertures (58) at a corresponding pin angle (78) relative to the mast longitudinal axis (44).

The vehicle implement adapter (10) preferably further includes an implement pivotal range limiting means for selectively limiting the pivotal movement of the implement (34) within a predetermined implement pivotal range. In a first embodiment of the invention illustrated in FIGS. 1 through 6, the implement pivotal range limiting means includes a range limiting arm (80) defining a range limiting arm first longitudinal end (82) and an opposed range limiting arm second longitudinal end (84). The range limiting arm first longitudinal end (82) is pivotally attached to the main arm (26) preferably adjacent the main arm second longitudinal end (30) while the range limiting arm second longitudinal end (84) is provided with an abutment tip (86).

The implement pivotal range limiting means also includes an arm pivoting mechanism attached to the range limiting arm (80) and extending towards the frame (24) for pivoting the range limiting arm (80) relative to the main arm or arms (26). Typically, the arm pivoting mechanism includes a pivoting shaft (88), pivotally mounted on the main arm (26) by a shaft supporting structure (90) and having a handle-type component (92) extending therefrom towards the vehicle (12). The opposed longitudinal end of the shaft (88) is threadably mounted to a linking arm (94) so that rotation of the handle (92) is transmitted to the linking arm (94) and transformed into a translational movement of the latter by the threaded connection. In turn, the translational movement of the linking arm (94) in a generally parallel direction relative to the main arm (26) is transferred into a pivotal movement of the range limiting arm (80) through a linkage arm-to-range limiting arm pivotal connection (96). The implement pivotal range limiting means of the embodiment shown in FIGS. 1 through 6, further includes a serrated surface (98) formed on the implement (34) on its surface adjacent the main arm (26). The serrated surface (98) is provided with indentations (100) that are configured and sized for receiving the abutment tip (86). The serrated surface (98) is positioned so that the abutment tip (86) is inserted into one of the indentations (100) when the implement (34) is pivoted towards the implement second pivotal position. The relative angle between the range limiting arm (80) and the main arm (26) thus determining the pivotal range of the implement (34).

In another embodiment of the invention shown in FIGS. 7 through 10, the implement pivotal range limiting means includes a guiding track (102) mounted on each main arm (26). Each guiding track (102) defines a corresponding track first longitudinal end (104) in an opposed track second longitudinal end (106).

The implement pivotal range limiting means of the embodiment shown in FIGS. 7 through 12 also includes a guiding arm (108). The guiding arm (108) defines a guiding arm first longitudinal end (110) and an opposed guiding arm second longitudinal end (112). The guiding arm first longitudinal end (110) is pivotally attached to the implement (34) while the guiding arm second longitudinal end (104) is slidably mounted within a corresponding guiding track (102) for slidable movement therealong. Each guiding track (102) is provided with range limiting components selectively positionable along the guiding track (102) for abuttingly limiting the relative movement between the guiding arm second longitudinal end (112) and the guiding track (102). Typically, the range limiting components take the form of range limiting pins (114) selectively inserted within corresponding track pin apertures (116) formed in the peripheral side walls of the preferably U-shaped guiding tracks (102).

The main actuating means preferably includes a main cable (118). The main cable (118) defines a main cable distal end and a main cable proximal end.

The main actuating also includes a winch-type component (120) mounted on the frame (24). The cable distal end is attached to the implement (34) so as to allow the main cable (118) to pull the implement (34) towards the implement second pivotal position while the cable proximal end is mechanically coupled to the winch-type component (120). Typically, although by no means exclusively, the main cable actuating means also includes a main cable pulley (122) attached to the mast (42) adjacent the mast second longitudinal end (48). The main cable (18) is then at least partially winded about the main cable pulley (122) intermediate the cable proximal and distal ends. Typically, although by no means exclusively, the cable is also re-directed by an auxiliary pulley (124) mounted on the frame (24) and positioned substantially adjacent the winch-type component (120).

In the embodiment of the invention illustrated in FIGS. 6 through 10, the main cable (118) is further re-directed by an implement pulley (126) mounted on the implement (34) and by a mast auxiliary pulley (128) mounted on the mast (42) underneath the main cable pulley (122). In this embodiment, the main cable (118) is then attached alongside the mast (42) while in the first embodiment shown in FIGS. 1 through 6, the distal end of the cable is attached to a cable attachment component (130) extending from the implement (34). Regardless of the type of configuration, the main cable (118) is attached to the implement (34) so as to allow pivotal movement of the latter between the implement first and second pivotal positions.

The frame (24) defines a frame first longitudinal end (132) and a frame second longitudinal end (134). The frame (24) includes a frame attachment section (136) for attachment to the conventional vehicle (12) and a frame supporting section (138) for supporting at least a portion of the weight of the main arm (26) and of the implement (38). The frame supporting section (138) is pivotally mounted to the frame attachment section so as to allow pivotal movement therebetween about a frame main pivotal axis (142) as indicated by arrow CXL, in FIGS. 2, 7 and 11. The frame supporting section (138) typically includes a first horizontal spacing section (144) extending into a vertical spacing section (46) and, again extending into a generally horizontal spacing section (148). The frame supporting section (138) typically includes a caster-type supporting wheel (150) pivotally and rollably attached to the second horizontal spacing section (148).

The frame (24) preferably further includes a suspension means attached between a frame attachment section (136) and the frame supporting section (138) for resiliently biasing the frame attachment section (136) and the frame supporting section (138) towards the predetermined angular relationship relative to each other. More specifically, the frame (24) preferably further includes a means for resiliently preventing the downward tilting of the front end (14) of the vehicle (12) when a heavy load is carried by the implement (34). The suspension means typically includes a set of resilient members, preferably taking the form of elongated spring plates (152), attached to corresponding spring plate brackets (154) and mounted to the frame attachment section (136) so as to abuttingly contact the first horizontal spacing segment (144) when the pivotal movement (140) reaches a predetermined value.

The frame attachment section (136) typically includes a generally elongated attachment rod (156), including a first rod attachment means for attaching the attachment rod (156) to the vehicle's rear attachment component and a second rod attachment means for attaching the attachment rod (136) to the vehicle's front attachment component. Typically, the rod first attachment means includes a rear rod attachment plate (158) provided with a generally concave configuration, configured and sized for substantially fittingly receiving the conventional vehicle's hitch towball (20). The attachment plate (158) is typically provided with its own adapter hitch towball (160) maintaining the conventional vehicle's ability to tow another vehicle although the original vehicle hitch towball (20) is used by the vehicle implement adapter (10).

The second rod attachment means is typically provided with a front attachment structure (162) configured for attachment to the front bumper (18) of the vehicle (12). Preferably, the front attachment component (162) is provided with a pivotable link (164) between the vehicle front attachment component (162) and the attachment rod (156). Typically, the attachment rod (156) extends into a pair of lateral attachment arms (168) which, in turn, extend into corresponding vertical attachment arms (166) to which the pivotal links (164) are pivotally attached. The attachment section (136) is preferably provided with lateral stabilizing components (170), positioned so as to extend on each side of the vehicle (12) and so as to abuttingly stabilize the vehicle (12) against sideward tilting. The reinforcement brace (172) preferably extends from each stabilizing arm (170) to a corresponding vertical spacing arm (166).

The implement (34) may be of the shovel-type defining a shovel scooping wall (174), a shovel abutment wall (176) and a shovel opening (178). Alternatively, the implement (34') may be of the grasping type, including a generally L-shaped implement bracket (174) attached to the main arm (26) and also including a jaw component (176), pivotally attached to the implement bracket (174) for pivotal movement between an implement first position wherein the jaw member is in a closed configuration relative to the implement bracket (174) and an implement second position wherein the jaw member (176) is in an open configuration relative to the implement bracket (174). Typically, the jaw member (176) includes a strip (178) of generally flexible material formed into a loop (180) about its distal end. A bottom section of the strip (178) is provided with teeth (182), extending therefrom. The jaw component (176) is adapted to be pivoted about a jaw pivotal axis (184) through the use of the main cable (118) attached thereto. The grasping-type of implement (34') is specifically intended to be used for grasping generally cylindrical items such as tree logs (186). It should be understood that other types of implements (34) could be attached to the main arm (26) without departing from the scope of the present invention.

The vehicle implement adapter (10) preferably includes implement locking means for locking the implement (34) in a predetermined angular relationship relative to the main arm (26). For example, the implement (34) could be locked in the angular configuration shown in FIG. 9 so that the shovel (34) can be used as a scraping shovel. Typically, the implement locking means includes a pin-type component extending throughone of the pin receiving apertures (116) and through the proximal of second end (112) of the arm (108).

It should be understood that although throughout the description reference is made to a main arm (26). A pair of main arms (26) could be used in parallel as shown schematically in FIGS. 8 and 12, without from the scope of the present invention.

In use, with both embodiments, winding of the main cable (118) on the winch-type component (120) results in either lifting of the implement (34) by pivotal movement of the main arm (26) about the main arm pivotal axis (32) and/or upward tilting of the implement (34) by pivotal movement of the implement (34) relative to the main arm (26) about the implement pivotal axis (40). The implement (34) will either be raised or upwardly tilted depending on the status of the sleeve locking mechanism. When the sleeve locking mechanism is in the locked configuration, winding of the main cable (118) on the winch-type component (120) will cause the implement (34) to pivot from the implement first pivotal position to the implement second pivotal position as illustrated by arrows in full lines in FIG. 3. With the sleeve locking mechanism in the locked configuration, unwinding of the main cable (118) from the winch-type mechanism (120) causes the implement (34) to pivot back towards the implement first pivotal position as indicated in phantom lines in FIG. 3.

When the sleeve locking mechanism is in the unlocked configuration, winding of the main cable (118) on the winch-type mechanism (120) causes initial upward tilting of the implement (34) to the implement second pivotal position which can be adjusted with the implement pivotal range limiting means. Once the implement (34) has pivoted to its implement second pivotal position, further winding of the main cable (118) on the winch-type mechanism (120) causes the main arm (26) to pivot from the main arm first pivotal position to the main arm second pivotal position. The sleeve locking mechanism can then be moved to its locked configuration to lock the main arm (26) in its raised pivotal configuration relative to the frame (24). Unwinding of the main cable (118) from the winch-type mechanism (120) with the sleeve locking mechanism in its unlocked configuration allows gravity to rotate the main arm (26) back towards the main arm first pivotal position.

The embodiments of the invention in which an exclusive privilege or property is claimed are defined as follows:

1. A vehicle implement adapter for attachment to a conventional vehicle, said conventional vehicle defining a vehicle front end and a vehicle rear end, said conventional vehicle including a vehicle front attachment component positioned adjacent said vehicle front end and a vehicle rear attachment component positioned adjacent said vehicle rear end, said vehicle implement adapter comprising:

a frame, said frame being configured so as to be attachable to said vehicle;

a main arm having a generally elongated configuration defining a main arm first longitudinal end and an opposed main arm second longitudinal end, said main arm first longitudinal end being pivotally attached to said frame so as to be pivotable about a main arm pivotal axis between a main arm first pivotal position and a main arm second pivotal position, said main arm second pivotal position being in an overlying relationship relative to said main arm first pivotal position;

an implement defining an implement proximal end and an implement distal end, said implement being pivotally attached to said main arm second longitudinal end so as to be pivotable about an implement pivotal axis between an implement first pivotal position and an implement second pivotal position, said implement second pivotal position being in an overlying relationship relative to said implement first pivotal position;

a main actuating means attached to both said frame and said implement for exerting a pulling action against the gravitational force on said implement, said pulling action being oriented so as to be able both to pivot said implement about said implement pivotal axis and to pivot said main arm about said main arm pivotal axis;

a main arm locking means attached to said main arm for selectively and releasably locking said main arm in a predetermined angular relationship relative to said frame;

said main actuating means and said main arm locking means being configured such that when said main arm locking means locks said main arm against pivotal movement about said main arm pivotal axis the pulling action of said main actuating means pivots said implement towards said implement second pivotal position while the release of said pulling action allows the gravitational force to pivot said implement towards said implement first pivotal position and, when said main arm is free to pivot about said main arm pivotal axis, the pulling action of said main actuating means pivots both said implement towards said implement second pivotal position and said main arm towards said main arm first position while the release of said pulling action allows the gravitational force to pivot both said implement towards said implement first position and said main arm towards said main arm first position.

2. A vehicle implement adapter as recited in claim 1 wherein said main arm locking means includes a mast extending from said frame, said mast defining a mast longitudinal axis, a mast first longitudinal end and a mast second longitudinal end, said mast being mounted on said frame about said mast first longitudinal end so as to be located intermediate said main arm first and second longitudinal ends;

a main arm-to-mast connecting means slidably mounted on said mast and pivotally attached to said main arm intermediate said main arm first and second longitudinal ends for slidably and pivotally connecting said main arm to said mast;

a mast connector locking means for selectively and releasably locking the relative movement between said main arm-to-mast connecting means and said mast.

3. A vehicle implement adapter as recited in claim 2 wherein said main arm-to-mast connecting means includes a mast sleeve slidably mounted on said mast said mast sleeve defining a sleeve peripheral wall;

said mast connector locking means includes a locking pin mounted on said mast sleeve;

at least one mast pin aperture formed in said mast for receiving a section of said locking pin;

a sleeve pin aperture extending through a section of said sleeve peripheral wall for receiving a section of said locking pin, said sleeve pin aperture being configured, sized and positioned relative to said sleeve so as to be positionable substantially in register with said at least one mast pin aperture by sliding said mast sleeve released configuration wherein said locking pin clears said at least one mast pin aperture relative to said mast;

said locking pin being mounted on said sleeve so as to be movable between a pin locked configuration wherein said locking pin extends through both said at least one mast pin aperture and said sleeve pin aperture and a pin released configuration wherein said locking pin clears said at least one mast aperture;

a pin actuating means for moving said locking pin between said pin locked and pin released configurations.

4. A vehicle implement adapter as recited in claim 3 wherein said locking pin is pivotally mounted to said mast sleeve and wherein said pin actuating means includes a pin pulling arm extending at an angle from said locking pin, said pin pulling arm being mechanically coupled to a pin pulling cable for pulling said locking pin towards said pin released configuration;

a pin pushing arm extending at an angle from said locking pin, said pin pushing arm being mechanically coupled to a biasing means for biasing said locking pin towards said pin locked configuration.

5. A vehicle implement adapter as recited in claim 4 wherein said at least one mast pin aperture extends at an angle relative to said mast longitudinal axis, said locking pin being oriented so as to slide into said at least one mast pin aperture at a corresponding pin angle.

6. A vehicle implement adapter as recited in claim 1 further comprising an implement pivotal range limiting means for selectively limiting the pivotal movement of said implement within a predetermined implement pivotal range.

7. A vehicle implement adapter as recited in claim 6 wherein said implement pivotal range limiting means includes a guiding track mounted on said main arm, said guiding track defining a track first longitudinal end and an opposed track second longitudinal end;

a guiding arm, said guiding arm defining a guiding arm first longitudinal end and an opposed guiding arm second longitudinal end, said guiding arm first longitudinal end being pivotally attached to said implement, said guiding arm second longitudinal end being slidably mounted to said guiding track for slidable movement therealong, said guiding track being provided with range limiting components selectively positionnable along said guiding track for abuttingly limiting the relative movement between said guiding arm second longitudinal end and said guiding track.

8. A vehicle implement adapter as recited in claim 6 wherein said implement pivotal range limiting means includes a range limiting arm, said range limiting arm defining a range limiting arm first longitudinal end and an opposed range limiting arm second longitudinal end, said range limiting arm first longitudinal end being pivotally attached to said main arm adjacent said main arm second longitudinal end, said range limiting arm second longitudinal end being provided with an abutment tip;

an arm pivoting mechanism attached to said range limiting arm and extending towards said frame for pivoting said range limiting arm to a predetermined angular relationship relative to said main arm;

a serrated surface formed on said implement adjacent said main arm, said serrated surface being provided with indentations configured and sized for receiving said abutment tip, said serrated surface being positioned so that said abutment tip is inserted into one of said indentations when said implement is pivoted towards said implement second pivotal position, the relative angle between said range limiting arm and said main arm determining the pivotal range of said implement.

9. A vehicle implement adapter as recited in claim 1 wherein said main actuating means includes a main cable, said main cable defining a cable distal end and a cable proximal end;

a winch mounted on said frame;

said cable distal end being attached to said implement so as to allow said cable to pull said implement towards said implement second pivotal position and said cable proximal end being coupled to said winch.

10. A vehicle implement adapter as recited in claim 2 wherein said main actuating means includes a main cable, said main cable defining a cable distal end and a cable proximal end;

a winch mounted on said frame;

a main cable pulley attached to said mast adjacent said mast second longitudinal end;

said cable distal end being attached to said implement so as to allow said cable to pull said implement towards said implement second pivotal position, said cable proximal end being coupled to said winch, said cable being at least partially winded about said main cable pulley intermediate said cable first and second longitudinal ends.

11. A vehicle implement adapter as recited in claim 1 wherein said frame defines a frame first longitudinal end and an opposed frame second longitudinal end, said frame including a frame attachment section for attachment to said conventional vehicle;

a frame supporting section for supporting at least a portion of the weight of said main arm and of said implement, said frame supporting section being pivotally mounted to said frame attachment section, adjacent said frame attachment section, said frame supporting section including a supporting wheel for rollably supporting said frame supporting section.

12. A vehicle implement adapter as recited in claim 11 wherein said frame further includes a suspension means attached between said frame attachment section and said frame supporting section for resiliently biasing said frame attachment section and said frame supporting section towards a predetermined angular relationship relative to each other.

13. A vehicle implement adapter as recited in claim 12 wherein said frame attachment section includes a generally elongated attachment rod, said attachment rod including a first rod attachment means for attaching said attachment rod to said vehicle rear attachment component and a second rod attachment means for attaching said attachment rod to said vehicle front attachment component, said second rod attachment means including a pivotal link between said vehicle front attachment component and said attachment rod.

14. A vehicle implement adapter as recited in claim 2 wherein said frame defines a frame first longitudinal end and an opposed frame second longitudinal end, said frame including a frame attachment section for attachment to said conventional vehicle; a frame supporting section for supporting at least a portion of the weight of said main arm and of said implement, said frame supporting section being pivotally mounted to said frame attachment section, adjacent said frame attachment section, said frame supporting section including a supporting wheel for rollably supporting said frame supporting section; said frame further including a suspension means attached between said frame attachment section and said frame supporting section for resiliently biasing said frame attachment section and said frame supporting towards a predetermined angular relationship relative to each other;

said frame attachment section including a generally elongated attachment rod, said attachment rod including a first rod attachment means for attaching said attachment rod to said vehicle rear attachment component and a second rod attachment means for attaching said attachment rod to said vehicle front attachment component, said second rod attachment means including a pivotal link between said vehicle front attachment component and said attachment rod, said mast extending from said frame supporting section and said main arm being pivotally attached to said frame attachment section.

15. A vehicle implement adapter as recited in claim 1 wherein said implement includes a shovel defining a shovel scooping wall and a shovel abutment wall.

16. A vehicle implement as recited in claim 15 further comprising means for locking said shovel in a predetermined angular relationship relative to said main arm.

17. A vehicle implement adapter as recited in claim 1 further comprising a generally "L"-shaped implement bracket rigidly attached to said main arm second longitudinal end and wherein said implement includes a jaw component pivotally mounted on said implement bracket for pivotal movement between said implement first position wherein said jaw member is in a closed configuration relative to said implement bracket and said implement second position wherein said jaw member is in an open configuration relative to said implement bracket.

18. A vehicle implement adapter for attachment to a conventional vehicle, said conventional vehicle defining a vehicle front end and a vehicle rear end, said conventional vehicle including a vehicle front attachment component positioned adjacent said vehicle front end and a vehicle rear attachment component positioned adjacent said vehicle rear end, said adapter comprising:

a frame, said frame being configured so as to be attachable to said vehicle;

a main arm having a generally elongated configuration defining a main arm first longitudinal end and an opposed main arm second longitudinal end, said main arm first longitudinal end being pivotally attached to said frame so as to be pivotable about a main arm pivotal axis between a main arm first pivotal position and a main arm second pivotal position, said main arm second pivotal position being in an overlying relationship relative to said main arm first pivotal position;

an implement defining an implement proximal end and an implement distal end, said implement being pivotally attached to said main arm second longitudinal end so as to be pivotable about an implement pivotal axis between an implement first pivotal position and an implement second pivotal position, said implement second pivotal position being in an overlying relationship relative to said implement first pivotal position;

a main actuator attached to both said frame and said implement for exerting a pulling action against the gravitational force on said implement, said pulling action being oriented so as to be able both to pivot said implement about said implement pivotal axis and to pivot said main arm about said main arm pivotal axis;

a main arm locking arrangement attached to said main arm for selectively and releasably locking said main arm in a predetermined angular relationship relative to said frame;

said main actuator and said main arm locking arrangement being configured such that when said main arm locking arrangement locks said main arm against pivotal movement about said main arm pivotal axis the pulling action of said main actuator pivots said implement towards said implement second pivotal position while the release of said pulling action allows the gravitational force to pivot said implement towards said implement first pivotal position and, when said main arm is free to pivot about said main arm pivotal axis, the pulling action of said main actuator pivots both said implement towards said implement second pivotal position and said main arm towards said main arm first position while the release of said pulling action allows the gravitational force to pivot both said implement towards said implement first position and said main arm towards said main arm first position.

19. A vehicle implement adapter as recited in claim 18 wherein said main arm locking arrangement includes a mast extending from said frame, said mast defining a mast longitudinal axis, a mast first longitudinal end and a mast second longitudinal end, said mast being mounted on said frame about said mast first longitudinal end so as to be located intermediate said main arm first and second longitudinal ends;

a main arm-to-mast connector slidably mounted on said mast and pivotally attached to said main arm intermediate said main arm first and second longitudinal ends for slidably and pivotally connecting said main arm to said mast;

a mast connector locking arrangement for selectively and releasably locking the relative movement between said main arm-to-mast connector and said mast.

20. A vehicle implement adapter for attachment to a conventional vehicle, said conventional vehicle defining a vehicle front end and a vehicle rear end, said conventional vehicle including a vehicle front attachment component positioned adjacent said vehicle front end and a vehicle rear attachment component positioned adjacent said vehicle rear end, said adapter comprising:

a frame, said frame being configured so as to be attachable to said vehicle;

a main arm having a generally elongated configuration defining a main arm first longitudinal end and an opposed main arm second longitudinal end, said main arm first longitudinal end being pivotally attached to said frame so as to be pivotable about a main arm pivotal axis between a main arm first pivotal position and a main arm second pivotal position, said main arm second pivotal position being in an overlying relationship relative to said main arm first pivotal position; an implement defining an implement proximal end and an implement distal end, said implement being pivotally attached to said main arm second longitudinal end so as to be pivotable about an implement pivotal axis between an implement first pivotal position and an implement second pivotal position, said implement second pivotal position being in an overlying relationship relative to said implement first pivotal position; a main actuator attached to both said frame and said implement for exerting a pulling action against the gravitational force on said implement, said pulling action being oriented so as to be able both to pivot said implement about said implement pivotal axis and to pivot said main arm about said main arm pivotal axis; a main arm locking arrangement attached to said main arm for selectively and releasably locking said main arm in a predetermined angular relationship relative to said frame; said main actuator and said main arm locking arrangement being configured such that when said main arm locking arrangement locks said main arm against pivotal movement about said main arm pivotal axis the pulling action of said main actuator pivots said implement towards said implement second pivotal position while the release of said pulling action allows the gravitational force to pivot said implement towards said implement first pivotal position and, when said main arm is free to pivot about said main arm pivotal axis, the pulling action of said main actuator pivots both said implement towards said implement second pivotal position and said main arm towards said main arm first position while the release of said pulling action allows the gravitational force to pivot both said implement towards said implement first position and said main arm towards said main arm first position;

said main arm locking arrangement including a mast extending from said frame, said mast defining a mast longitudinal axis, a mast first longitudinal end and a mast second longitudinal end, said mast being mounted on said frame about said mast first longitudinal end so as to be located intermediate said main arm first and second longitudinal ends; a main arm-to-mast connector slidably mounted on said mast and pivotally attached to said main arm intermediate said main arm first and second longitudinal ends for slidably and pivotally connecting said main arm to said mast; a mast connector locking arrangement for selectively and releasably locking the relative movement between said main arm-to-mast connector and said mast; said vehicle implement adapter further comprising an implement pivotal range limiter for selectively limiting the pivotal movement of said implement within a predetermined implement pivotal range.

* * * * *